US009714118B2

(12) United States Patent
Han

(10) Patent No.: US 9,714,118 B2
(45) Date of Patent: Jul. 25, 2017

(54) INNER LAMINATED WOVEN BAG FOR FOOD PACKAGING

(75) Inventor: Su Youn Han, Edgewater, NJ (US)

(73) Assignee: PacSense Corp., Edgewater, NJ (US)

( * ) Notice: Subject to any disclaimer, the term of this patent is extended or adjusted under 35 U.S.C. 154(b) by 291 days.

(21) Appl. No.: 13/585,569

(22) Filed: Aug. 14, 2012

(65) Prior Publication Data

US 2013/0040084 A1 Feb. 14, 2013

Related U.S. Application Data

(63) Continuation-in-part of application No. 13/541,927, filed on Jul. 5, 2012, now abandoned.

(60) Provisional application No. 61/523,025, filed on Aug. 12, 2011.

(51) Int. Cl.
*B29D 22/00* (2006.01)
*B65D 30/08* (2006.01)
*B65D 33/01* (2006.01)

(52) U.S. Cl.
CPC ..... *B65D 29/02* (2013.01); *B65D 33/01* (2013.01); *Y10T 428/1341* (2015.01)

(58) Field of Classification Search
CPC .... B65D 29/02; B65D 33/01; B32B 2439/46; B32B 5/024
USPC ..... 428/35.4
See application file for complete search history.

(56) References Cited

U.S. PATENT DOCUMENTS 4,557,385 A * 12/1985 Robinson ..... B65D 75/58 383/200
6,179,467 B1 * 1/2001 Derby ..... B29C 66/8362 383/113
6,286,681 B1 * 9/2001 Wilfong, Jr. ..... B65D 33/001 206/554
2003/0072505 A1 * 4/2003 Pihl ..... B29C 55/06 383/75
2005/0276521 A1 * 12/2005 Price ..... 383/10
2007/0140600 A1 * 6/2007 Nowak et al. ..... 383/116

* cited by examiner

*Primary Examiner* — James Yager
(74) *Attorney, Agent, or Firm* — Plumsea Law Group, LLC

(57) ABSTRACT

The composite bag of the present invention generally comprises a multi-layered, inner laminated woven bag for bulk packaging of food products, particularly rice and grain products. The composite bag of the present invention generally comprises a top outer layer made of a polymer film and further comprising an anti-skid coating on one surface and reverse printed matter on its opposing surface; a middle layer comprising a polymer woven layer; a base inner-barrier layer comprising a polymer film that forms the interior liner of the composite bag; and a plurality of holes formed by the top outer layer, the middle layer, and the base inner-barrier layer. The layers of the present invention can be adhesively laminated to each other.

13 Claims, 2 Drawing Sheets

INNER LAMINATED WOVEN BAG FOR FOOD PACKAGING

CROSS REFERENCE TO RELATED APPLICATIONS

This application is a continuation-in-part of U.S. patent application Ser. No. 13/541,927 filed Jul. 5, 2012 which claims the benefit of U.S. Provisional Application No. 61/523,025 filed Aug. 12, 2011, the disclosures of which are hereby incorporated herein by reference in their entireties.

FIELD OF INVENTION

The present invention relates to bulk packaging for food and non-food products, including but not limited to rice and grain products.

BACKGROUND OF THE INVENTION

The prior art discloses several alternatives for packaging bulk products, particularly for small particle contents such as rice and grain or powder form contents such as sugar, flour or grain powder. For example, multiwall bags may comprise an outer, lacquer-coated paper layer or wall with flexographic printing on the surface, and an inner layer or wall constructed with kraft paper. Although these prior art multiwall paper bags can be durable in structure, the printing quality is poor and thus not appealing to today's consumers. They are also associated with undesirable contamination of the bag contents with contaminants such as paper dust.

Alternatively, prior art multilayered plastic bags may comprise printed matter on top of a single layer, or a top layer with reverse printed matter laminated to a middle layer so the printed matter is situated in between the first and middle layers. Also a base layer can be laminated to come in direct contact with the inner contents of the bag. These prior art multi-layered plastic bags may further include printed matter, such as graphics, product information, logos, and the like wherein the printed matter is reverse printed to the laminated side of a first layer so that it is viewed through a second opposing laminate layer. While the printing quality of these prior art multi-layered plastic bags can be superior to other known multiwall bags, prior art multi-layered plastic bags are often less durable in structure.

To overcome some of the deficiencies with paper multiwall bags and plastic multi-layered bags, prior art bags for bulk products have also comprised polymer woven bags. These prior art woven bags may comprise a single polymer woven layer with printed matter on top or a top layer of film with reverse printed matter laminated to the polymer woven layer, or alternatively, a top layer of printed paper coated then laminated to the polymer woven layer.

Although the durability of the structure is enhanced in these prior art woven bags, thus making them more suitable for bulk packaging, many common problems are nevertheless associated with these prior art woven bags, particularly where a polymer woven layer is in direct contact with the bag contents. For example, substandard materials and construction can be associated with the fabrication of the polymer woven layer, which often leads to deterioration of the strength and integrity of the bag, and in some instances, mixing of woven strips with the contents of the bag—a significant public health concern.

These prior art composite bags, while functional, nevertheless fail to meet expectations (particularly for packaging bulk products of small particle contents such as rice and grain or powder form contents such as sugar, flour or grain powder), partly because these prior art bags can be aesthetically unattractive as a result of limited printing methods and poor printing quality. Moreover, while some prior art, multi-layered plastic bags have enhanced printing quality and aesthetic appearance, many of these bags are less durable and less appropriate for packaging bulk products. These prior art bags are also associated with undesirable contamination of the bag contents.

Additionally, the oxygen transmission rate and moisture, humidity or water vapor transmission rate of a bag must also be considered when the bag contents comprise dry powder form contents such as sugars, flours, and grain powders. When bag contents comprise dry powder form contents such as sugars, flours, and grain powders, the contents quickly gain or lose moisture until they are at equilibrium with the environmental relative humidity, and may consequently succumb to undesirable affects, such as becoming soggy or clumping together. Bags containing such contents should include a high barrier layer to block moisture and oxygen transmission in the bag.

Prior art composite bags for small particle contents, such as rice and grain products often include poor ventilation which can increase the moisture or relative humidity of the bag contents and the oxygen concentrations in the bag, thus leaving the contents more susceptible to mold formation and spoilage. Therefore, with respect to bags containing small particle contents such as rice and grains, there is a need for a composite bag that provides a plurality of holes that properly maintains the oxygen transmission rate and moisture or humidity transmission rates of the bag contents.

SUMMARY OF THE INVENTION

The present invention generally comprises a composite bag that is ideal for bulk packaging and provides an overall improved appearance, quality, and utility over existing prior art composite bags. It is an object of the present invention to protect the contents of the woven composite bag from contaminants while simultaneously controlling the humidity, moisture level, and gas composition of the interior of the bag to provide safer and healthier food packaging solutions, such as, for example, the packaging of rice and grain, grain powder including flour or powder mix and sugar products.

The present invention embodies a woven structure that holds the bulk packaging with overall improved appearance and quality that is more appealing to consumer markets. Moreover, the present invention is designed to protect contents from outer contamination by adding an inner barrier layer laminated to the woven structure to control the humidity and moisture level of the bag contents as well as the gas composition of the bag contents by the preferable incorporation of a plurality of air holes.

The composite bag of the present invention generally comprises a top outer layer that may further comprise an anti-skid coating or lamination on a first surface and reverse printed matter on a second surface; a middle polymer woven layer; and a base inner-barrier layer comprising the interior liner of the bag of the present invention. All layers of the present invention can be adhesively laminated to each other.

It is therefore an object of the present invention to utilize a multi-layer composite structure to increase the overall strength and durability of the bag.

It is a further object of the present invention to provide an aesthetically appealing composite bag with high print quality, while simultaneously providing a composite bag that is sufficiently durable for packaging bulk products, particularly for small particle contents such as rice and grain or powder form contents such as sugar, flour or grain powder.

It is a further object of the present invention to provide an interior, food-safe liner that comes into contact with the contents of the bag and creates a barrier between the contents and the remaining layers to prevent ink or broken woven strips from mixing with the contents of the bag.

Preferably, the composite bag of the present invention further comprises a plurality of air holes formed through the composite layers of the bag to help the contents of the bag retain a desired equilibrium relative humidity with the atmosphere thus helping to reduce the risk of mold formation, as well as prevent cracking, sticking, and spoilage of the bag contents. Moreover, the plurality of air holes also helps control the internal oxygen level of the bag which can be beneficial for prolonged storage and shelf life.

Other alternative embodiments of the present invention may include easy-to-open seams, gusseted edges for improved dimensional stability and flatness, a back seam for improved strength and reliability, and an anti-skid coating or lamination on the surface layer.

The following description and the annexed drawings set forth in detail certain illustrative aspects of the invention. These aspects are indicative, however, of but a few of the various ways in which the principles of the invention may be employed and the present invention is intended to include all such aspects and their equivalents. Other advantages and novel features of the invention will become apparent from the following detailed description of the invention when considered in conjunction with the drawings.

DETAILED DESCRIPTION OF THE PREFERRED EMBODIMENTS

Figure 1:
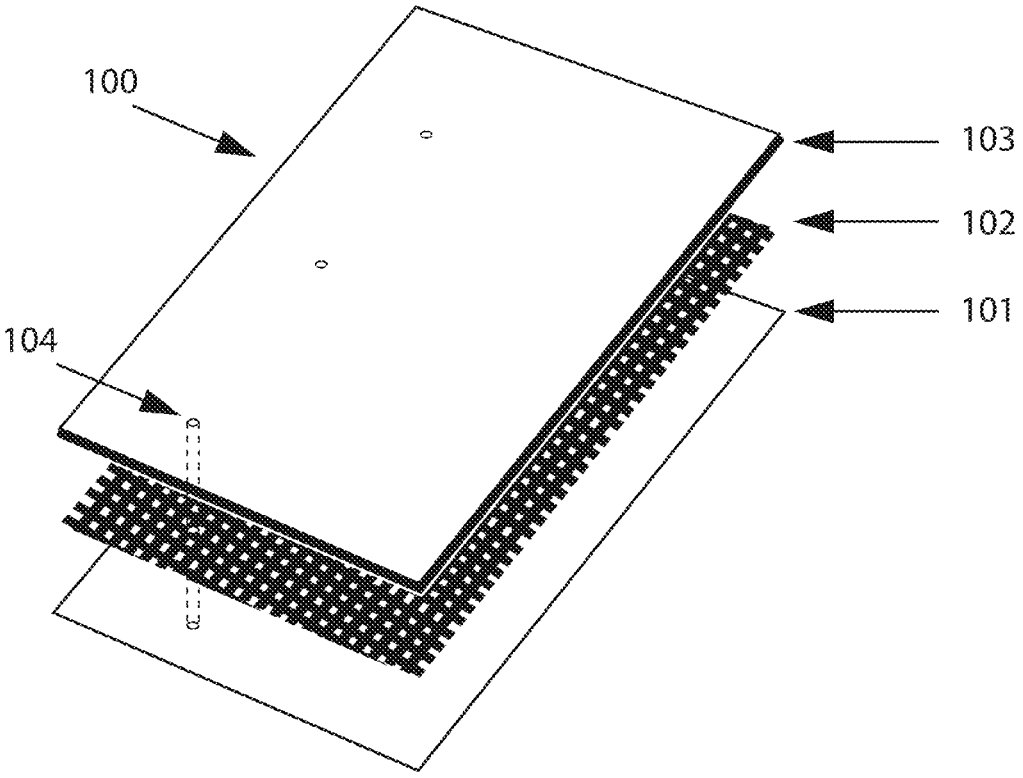
FIG. 1 depicts a perspective view of the multi-layer composite structure of the present invention.

As depicted in FIG. 1, the composite bag 100 of the present invention generally comprises a base inner-barrier layer 101, preferably comprised of a polymer film; a middle layer 102, preferably comprised of a polymer woven layer; and a top outer layer 103, preferably comprised of a polymer film. As further depicted in FIG. 1, preferably, a plurality of air holes 104 is formed through the base inner-barrier layer 101, the middle layer 102, and the top outer layer 103 to help the contents of the bag retain a desired equilibrium relative humidity with the atmosphere as well as control the internal oxygen level of the bag.

Figure 2:
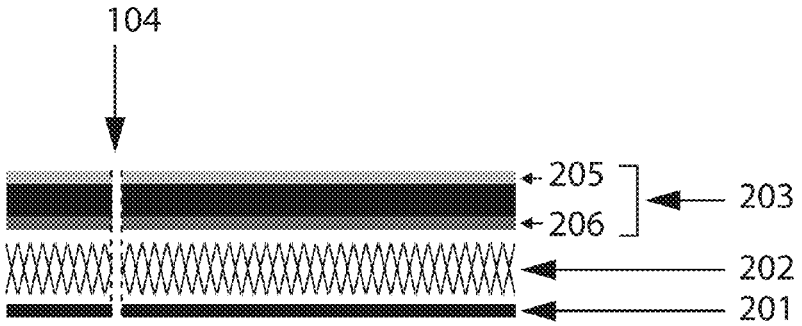
FIG. 2 depicts a cross section of the multi-layer composite structure of the present invention.

As depicted in FIG. 2, the top outer layer 203 of the composite bag of the present invention preferably comprises an anti-skid coating or lamination on its first outer surface 205, and reverse printed matter on its second inner surface 206. As used herein, the term "printed matter" may include graphics, product information, logos and the like. The middle layer 202 is then laminated to the second inner surface 206 of the the top outer layer 203 to provide a composite, wherein the printed matter is sandwiched between the the top outer layer 203 and the middle layer 202.

As further depicted by FIG. 2, the base inner-barrier layer 201 is laminated to the middle layer 202 so that the base inner-barrier layer 201 forms the interior liner of the composite bag and therefore comes into contact with and protects the contents of the bag.

In preferred embodiments of the present invention, the base inner-barrier layer 201, middle layer 202, and top outer layer 203 can be adhesively laminated to one another. In another embodiment of the present invention, the middle layer 202 is preferably a polymer woven layer comprised of suitable film-forming plastic resin strips interlaced or weaved together to form a net-like structure.

Figure 3:
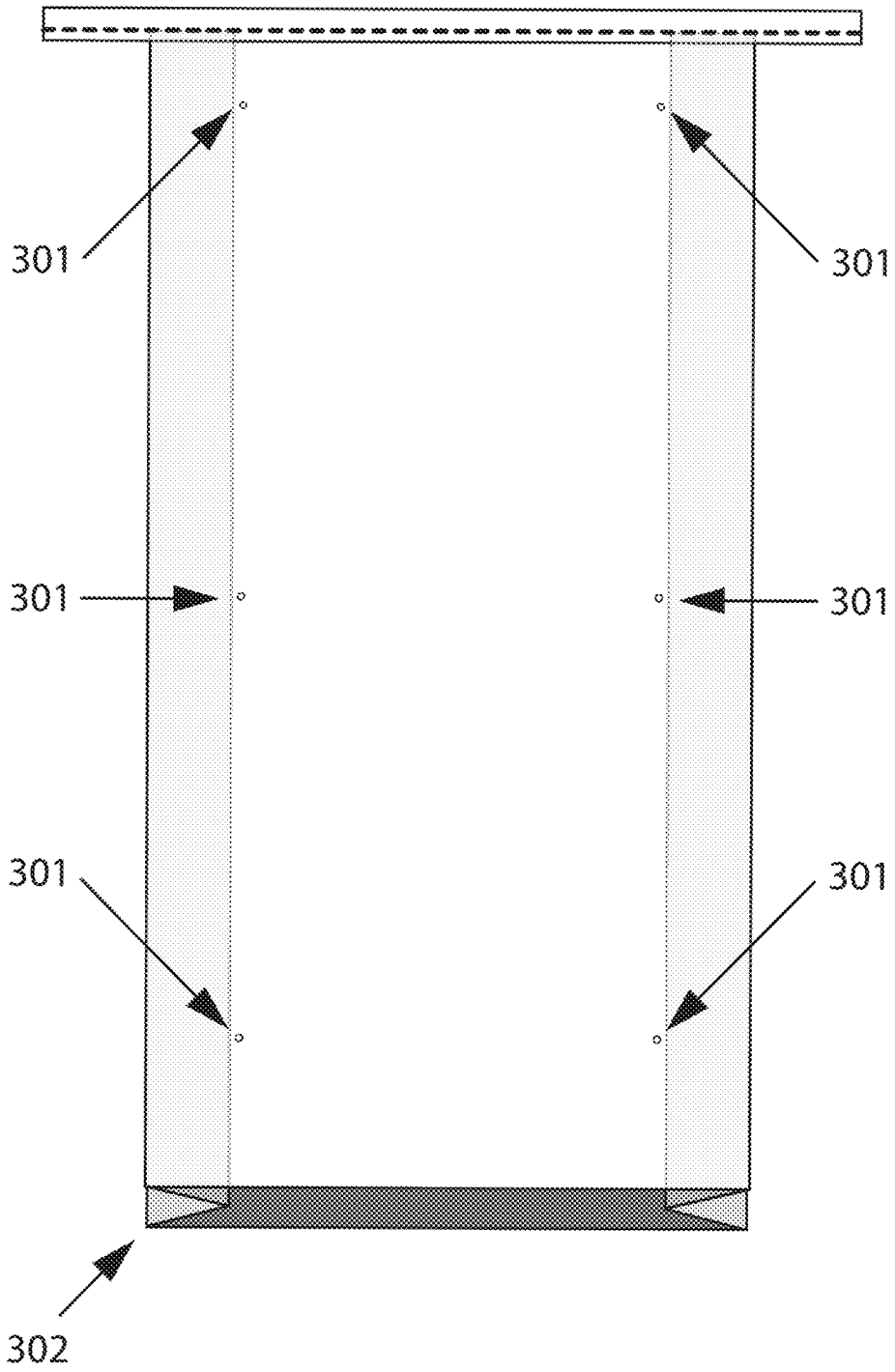
FIG. 3 depicts a perspective view of the present invention with a plurality of breathing holes or air holes formed in the gusseted edges of the composite bag. The number of breathing holes or air holes can be added or reduced depending on the characteristics and needs of the inner contents.

As depicted in FIG. 3, once the middle layer 202 is laminated with the base inner-barrier layer 201 and top outer layer 203, the edges of the composite structure can be gusseted.

As further depicted in FIG. 3, the composite bag of the present invention preferably comprises a plurality of air holes 301 punched through the plurality of composite layers as described above. The number of breathing holes or air holes can be added or reduced depending on the characteristics and needs of the inner contents. As further depicted in FIG. 3, the gusseted edges 302 of the resulting composite bag are then punched with one or more breathing holes or air holes which are preferably between 0.01 inches to 0.1 inches in diameter.

The foregoing description of possible embodiments consistent with the present invention does not represent a comprehensive list of all such implementations or all variations of the implementations described. The description of only some implementation should not be construed as an intent to exclude other implementations. For example, one of ordinary skill in the art will understand how to implement the invention in many other ways, using equivalents and alternatives that do not depart from the scope of the invention. Moreover, unless indicated to the contrary in the preceding description, none of the components described in the implementations are essential to the invention.

What is claimed is:

1. A composite food packaging bag comprising a front side being generally rectangular and planar and a back side being generally rectangular and planar, the front side disposed opposite the back side, wherein the front side is connected to the back side along two parallel side edges;

the two parallel side edges each including a gusset;

the gusset including a front folded portion connected to the front side, and a rear folded portion connected to the rear side, the gusset also including a plurality of air holes arranged in a single line parallel to the side edges and penetrating the front side, the front folded portion, the rear folded portion and the rear side, wherein the plurality of air holes have a diameter of between 0.01 and 0.1 inches;

the composite food packaging bag including a first end edge and a second end edge, the composite food packaging bag being open along a second end edge to define an opening between the front side and the back side to an interior portion of the composite food packaging bag, the front side, the rear side and the gusset each including:

a base inner-barrier layer, said base inner-barrier layer including a continuous polymeric film layer;

a middle layer including a polymer woven layer comprising plastic resin strips forming a woven structure, the inner barrier layer being bonded completely coextensively to the woven structure; and a top outer layer laminated to said middle layer, said top outer layer including a polymer film, wherein the bag is configured to lay flat prior to being filled with a food product and wherein the base inner-barrier layer of the front side faces the base inner-barrier layer of the front folded portion in the gusset.

2. The composite food packaging bag of claim 1, wherein each of said plurality of air holes being defined by a peripheral edge that is defined by said base inner-barrier layer, said middle layer, and said top outer layer.

3. The composite food packaging bag of claim 1, wherein said top outer layer further includes a first outer surface, said first outer surface further comprising an anti-skid coating or lamination.

4. The composite food packaging bag of claim 1, wherein the top outer layer includes reverse printed matter.

5. The composite food packaging bag of claim 4, wherein the reverse printed matter is disposed between the top outer layer and the middle layer.

6. The composite food packaging bag of claim 1, wherein the base layer is constructed of a food safe material.

7. The composite food packaging bag of claim 1, wherein said plurality of air holes are defined by a peripheral edge defined by said gusseted base inner-barrier layer, said gusseted middle layer, and said gusseted top outer layer.

8. The composite food packaging bag of claim 1, wherein said middle layer further includes film-forming plastic resin strips woven together to form a net-like structure.

9. A composite food packaging bag comprising:

a front side and a back side, the front side and the back side together defining an interior volume, side edges including gussets connecting the front side to the back side, the gussets including a front folded portion connected to the front side, and a rear folded portion connected to the rear side, the gussets also including a plurality of air holes arranged in a single line parallel to the side edges and disposed through the front side, the front folded portion, the rear folded portion and the rear side, wherein the plurality of air holes have a diameter of between 0.01 and 0.1 inches; the front side, the back side and the side edges including gussets comprising:

a base layer including a polymer film;

an intermediate layer including a polymer woven layer comprising plastic resin strips forming a woven structure, the base layer being bonded completely coextensively with the woven structure;

a top layer disposed outwardly with respect to the intermediate layer and including a top polymer film, the composite food packaging bag having an outer surface and an inner surface, wherein the base layer substantially defines an internal surface of the composite food packaging bag and the top layer substantially defines an external surface of the composite food packaging bag, wherein the base layer of the front side faces the base layer of the front folded portion and wherein the base layer of the back side faces the base layer of the back folded portion.

10. The composite food packaging bag of claim 9, wherein at least one of the front and back sides defines a plurality of holes therethrough, each hole having a peripheral edge defined by the base layer, the intermediate layer, and the top layer.

11. The composite food packaging bag of claim 10, wherein each of the plurality of holes is disposed adjacent to one of the gusseted edges.

12. The composite food packaging bag of claim 10, wherein the top outer layer includes reverse printed matter, and wherein the reverse printed matter is disposed between the top outer layer and the middle layer.

13. The composite food packaging bag of claim 9, wherein the top layer includes an anti-skid coating or lamination provided along the outer surface of the polymer film.

* * * * *